US005845849A

United States Patent [19]

Mitzlaff

[11] Patent Number: 5,845,849

[45] Date of Patent: Dec. 8, 1998

[54] SPRINKLER

[75] Inventor: Lothar Mitzlaff, Ulm, Germany

[73] Assignee: Gardena Kress + Dastner GmbH, Germany

[21] Appl. No.: 917,998

[22] Filed: Aug. 25, 1997

[30] Foreign Application Priority Data

Aug. 24, 1996 [DE] Germany ..... 196 34 332.1

[51] Int. Cl.[6] ..... B05B 15/10

[52] U.S. Cl. ..... 239/203; 239/206

[58] Field of Search ..... 239/203, 206, 239/225.1, 231, 232, 233, 251

[56] References Cited

U.S. PATENT DOCUMENTS 4,815,662 3/1989 Hunter ..... 239/222.17
4,932,590 6/1990 Hunter ..... 239/222.17
4,971,250 11/1990 Hunter ..... 239/222.17
5,058,806 10/1991 Rupar ..... 239/205

FOREIGN PATENT DOCUMENTS 0 724 913 A2 11/1995 European Pat. Off. ..... B05B 1/26
296 03 947 U1 3/1996 Germany ..... A01G 25/00

*Primary Examiner*—Andres Kashnikow
*Assistant Examiner*—David Deal
*Attorney, Agent, or Firm*—Quarles & Brady

[57] ABSTRACT

A sprinkler comprises a turbine rotor (64) and a nozzle means (20) driving the latter, the water jets emerging from the nozzle means (20) as fanned jets so that the water impinges the surface area to be irrigated at a relatively small distance away from the sprinkler also under high pressure. The nozzle means (20) is mounted rotatably to enable differing sectors or sectors differing in size to be irrigated.

20 Claims, 2 Drawing Sheets

SPRINKLER

TECHNICAL FIELD AND BACKGROUND OF THE INVENTION

The invention relates to a device with which a fluid such as water, can be discharged onto a vegetation surface area or the like as a jet, this jet following release from the device gaining access to the vegetation surface area bundled or atomized in a free trajectory under fluid pressure at the fluid outlet, it thereby initially rising from the device or dropping to the surface area to be irrigated. The device or sprinkler may be anchored by a sprinkler base standing upright on the ground of the site concerned so that the fluid outlet provided at its upper end is located spaced away from the top of the anchorage. The sprinkler base comprises a supply connection for releasably connecting a fluid line, such as a water hose, via which the fluid is supplied pressurized to a system of passages leading to the outlet from the connection within the sprinkler.

Expediently the outlet is movable, more particularly rotatable, relative to the base and is driven in its movement by the flowing water so that with the water emerging from the outlet a larger surface area can be sprinkled than would be the case if the outlet were unmoved. For example, a plurality of radially oriented outlets may be provided on a rotor rotating constantly in the same direction, such as a turbine rotor, so that the water is discharged in an overall sector of 360° about the axis of rotation or in partial sectors smaller relative thereto. In this arrangement the discharge may occur in each case up to the vicinity of the sprinkler so that the same jet of water comes into contact with the surface area to be sprinkled over a relatively large distance radial to the sprinkler.

This radial extent or the minimum distance of the surface area to be sprinkled by the sprinkler depends on the jetting cross-sections which the jet of water has at the fluid outlet or upstream thereof within the sprinkler. Expediently a nozzle array is provided within the sprinkler from which the water emerges as a jet so that it gains access to a guiding surface area in a free trajectory which supplies it to the fluid outlet. The latter may be formed by the outlet end of the guiding surface area. The nozzle array comprises several juxtaposed nozzle units spaced radially equidistant about the spindle, each of which directs a separate jet against separate portions of the guiding surface area body and thus supplying only the partial sector of the vegetation surface area remaining the same in each case with water. By closing off the corresponding nozzle unit the corresponding partial sector can be excluded from sprinkling. Each individual nozzle unit may be formed by a single or several jetting nozzles, the jetting cross sections emanating from the nozzle unit or impinging the guiding surface area also dictating the shape of the jet at the fluid outlet. If the nozzle unit is formed by a single circular orifice as viewed in the direction of flow, then a jet materializes which is maximally concentrated and which can be discharged as of the fluid outlet over a long distance without sprinkling the region of the vegetation surface area in the immediate vicinity of the sprinkler.

OBJECT OF THE INVENTION

The invention is based on the objects of defining a sprinkler device which obviates the drawbacks of known configurations or of the kind as described and which, more particularly, permits generating a jet of fluid which is suitable for sprinkling the near zone of the sprinkler or discharging less far than the described far-reaching water jet.

SUMMARY OF THE INVENTION

In accordance with the invention means are provided upstream of the fluid outlet to influence the jetting cross-section generated by each individual nozzle unit so that it has a cross-sectional shape other than circular and impinging the guiding surface area in this deviating shape. Due to such a jet which is already fan-shaped upstream of the fluid outlet the jet leaving the fluid outlet is also less bundled, this being the reason why it also sprinkles the vegetation surface area in the vicinity of the sprinkler after having described a short parabolic trajectory.

Although it is feasible to translate the jet on and after exit from the nozzle unit or on or prior to impinging the guiding surface area into the cited jet shape by baffles, this is expediently done by correspondingly shaping the definition of the nozzle e.g. so that as viewed axially the nozzle unit is to be defined by an imaginary enveloping surface area which is elongated. Within this enveloping surface area a central larger jetting nozzle and laterally juxtaposed thereto at least one narrower jetting nozzle could be provided, whereby one or all jetting nozzles are circular and unify the water jets leaving them into a common jet prior to impinging the guiding surface area. Expediently, however, only a single jetting nozzle is provided which as viewed axially is defined not circular but elongated, e.g. oval, lenticular or near-oval in shape, as a result of which the nozzle may comprise laterally narrower portions and a widened portion inbetween so that the cited jetting cross-sections are generated. As viewed axially the largest cross-sectional extent of the nozzle is expediently located at right angles to the associated jet leaving the fluid outlet, this resulting in the latter being correspondingly widened and thus ejecting less far or assuming a fan shape already prior to leaving the fluid outlet parallel to and/or at right angles to the surface area being sprinkled.

As a result of this arrangement the jetting nozzle also forms juxtaposed portions differing in the flow velocity of the water which as viewed axially are located alongside each other. In the region of the narrow sides of the nozzle unit the flow velocity is higher than adjacent thereto in the widened nozzle portion.

Each guiding surface area is expediently formed by a depression, such as a groove, along the bottom and flanking surface areas of which the water is guided in a trajectory curved radially outwards. The larger extent of the nozzle unit is expediently larger than the width of the depression as measured in the same direction and smaller than the smallest depth thereof so that the jet leaving the nozzle unit impinges not only on the depression but also on the protuberances defining the depression on both sides by their flanks or are located between two adjacent depressions in each case. Accordingly by the surface area of its head the protuberance in each case could form a guiding surface area for the water displaced relative to the bottom surface area of the depression in the direction contrary to that of the flow so that the water on leaving the fluid outlet is fanned even further, namely transversely to the surface area to be sprinkled. The guiding surface areas are provided advantageously on a body widened in the direction of flow, this body forming the rotor. The latter may be driven only by the water jets leaving the nozzle units, i.e. solely hydraulically so that a very simple configuration of the sprinkler materializes.

As viewed axially the nozzle units are arranged in a circle about a mounting or bearing body for the guiding or rotor body so that each individual nozzle unit can be located directly adjacent to the hub of the rotor. Each nozzle may be located recessed so that in the direction of flow it is adjoined by guide flanks opposing each other which stabilize the shape of the jet on parting from the nozzle before leaving the flanks and gaining access to the guiding surface area practically without contact in a free trajectory. The two flanks are located of the broadsides of the nozzle unit and may be formed by a V-shaped groove. Like the corresponding connection of the guide flank the definition of the nozzle configured as a continual or integral parting edge for the jet may also comprise sections mutually staggered axially. More particularly, the sections forming the narrow sides of the nozzle unit are recessed relative to the sections forming the broadsides since the narrow sides are located on the acute bottom of the groove forming the guide flanks.

The nozzle unit forms the end of a nozzle passage oriented in the direction of flow, this passage comprising a passage end section tapered towards the jetting nozzle, as a result of which a jet of fluid materializes which becomes continually wider in the direction of flow and in the plane between the broadsides of the jetting nozzle. The result of this is that the water jet is also wider at the fluid outlet of the rotor so that the end portions of the individual sprinkling sectors overlap to ensure a more consistent sprinkling.

For opening up and closing individual partial sectors of the sprinkling zone positioning means are provided, the nozzle unit or the complete nozzle array being preferably manually rotatable relative to the sprinkler base and also relative to the guiding surface areas and the fluid outlet. Expediently the nozzle array is provided on a nozzle head which in operation forms the upper end of the sprinkler base, protrudes into the lower ends of the guiding surface areas, the outer circumference of which forms a handle for translating the nozzle array into various positions. A positioner or valve element movable or rotatable relative to the nozzle head closes off or opens up each and any of the nozzle units individually, depending on the position. This valve or control element closes off inlet ends of the nozzle passages to advantage, the other ends of which located downstream form a single nozzle unit or the nozzle thereof in each case and extend from the control element up to the latter in one piece.

These and further features are also evident from the description and the drawings, each of the individual features being achieved by themselves or severally in the form of subcombinations in one embodiment of the invention and in other fields and may represent advantageous aspects as well as being patentable in their own right, for which protection is sought in the present.

BRIEF DESCRIPTION OF THE DRAWINGS

Example embodiments of the invention are explained in more detail in the following and illustrated in the drawings in which.

DETAILED DESCRIPTION

Figures 1, 2:
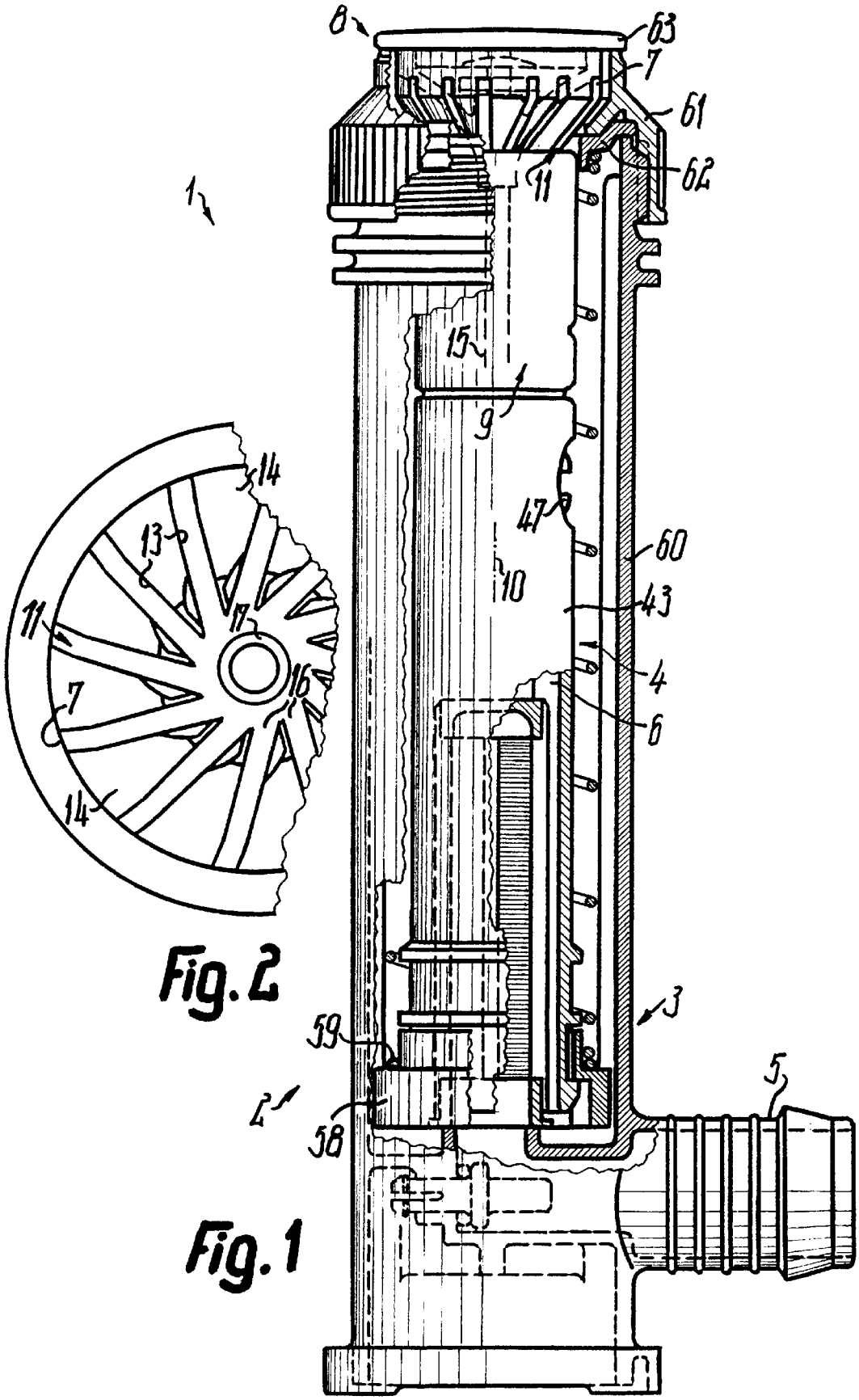
FIG. 1 is a partial axial view of the sprinkler in accordance with the invention.
FIG. 2 is an axial view of the rotor as shown in FIG. 1, but here on a magnified scale.

The device as shown in FIG. 1 is configured as a recessed sprinkler 1, the body 2 of which comprises two units 3, 4 telescopically shiftable into each other and always mutually prevented from turning relative to each other. The outer unit 3 to be firmly anchored relative to the standing surface area or ground may be recessed over the majority of its length and arranged firmly anchored in the ground so that from its upper end the inner unit 4 can be extended into the operating position in which the inner unit freely protrudes from the unit 3 by the majority of its length. Both units 3, 4 are elongated substantially tubular. In the lower portion the unit 3 features a radial supply connection 5 for connecting a hose or the like, via which tap water is supplied pressurized to a system of passages 6 the flow paths of which in the operating position are defined in the lower portion by the unit 3 and upwards at the lower end of the unit 4 subsequently defined only by the latter.

The upper end of the system of passages 6 is formed by a plurality of at least eight or ten outlets 7 which are provided at a head 8 forming the uppermost end of the sprinkler 1 level therewith and spaced equidistant from each other. At the outlets 7 the water releases oriented slantingly upwards from the sprinkler 1 completely or without contact therewith and gains access via a parabolic trajectory to the surface area of the vegetation site to be sprinkled. The head 8 and the outlets 7 receive all of the water without bypass through a nozzle head 9 forming the upper end of the unit 4, this nozzle head like the sprinkler 1 or the units 2 to 4, 7 and 8 being located in a central spindle 10 or symmetrically thereto. The identical outlets 7 are distributed about the spindle 10 equidistant radially and circumferentially.

Each of the outlets 7 defined mutually integrally is formed by the downstream end of a separate guiding surface area 11 or depression or groove which over its length has a constant width, differing in depth and shaped angled or curved as shown in FIG. 1 such that the kick-back effect of the water emerging from the outlets 7 causes the head 8 to be directly spun about the spindle 10. All guiding surface areas 11 are oriented slightly inclined the same and relative to a radial arrangement also in the region of their radial inlet ends in the direction of flow contrary to the direction of rotation as is evident from the axial view parallel to the spindle 10 as shown in FIG. 2. Each guiding surface area 11 comprises a bottom surface area 12 oriented slanting upwards as viewed axially in the direction of flow or curved concavely throughout and adjoining thereto two lateral flank surface areas 13 parallel to each other and to the spindle 10, these flank surface areas being formed by protuberances 14 located between adjacent guiding surface areas 11.

All protuberances 14 form by their head surface areas a lower outer circumference flared maximally at right angles or at an acute angle conically upwards, this outer circumference adjoining a cylindrical circumference through which the outlets 7 pass due to these being formed by the downstream end of the guiding surface areas 11. The grooves 11 guide the water so that it is deflected from an entry direction parallel to the spindle 10 progressively radially outwards up to the outlets 7, it then emerging at these as well as, where necessary, in the region of the conical circumference since it is here that the corresponding groove 11 has its minimum depth and the longitudinal openings of the groove pass through this conical circumference between adjacent protuberances 14 whilst the end opening of the groove 11 passes through the cylindrical circumference. The greater depth of the groove 11 oriented full length relative to the width of the groove diminishes over this full length towards the outlet 7.

The head 8 is penetrated by a mounting body 15 which is formed over its full length by a straight round-section bar of constant outer cross sections and is rotatably mounted on the head 8 by a central hub 17. Located adjacent to the outer circumference of the lower, freely protruding end of the hub 17 are the axial inlets 16 of the guiding surface areas 11 such that this cylindrical outer circumference smoothly translates into the curved surface areas 12 and protrudes opposite to the direction of flow downwards beyond the inlets 16 and the protuberances 14 or the conical outer circumference respectively. This lower end of the hub 17 configured integrally with the head 8 extends almost up the upper end of a sleeve-shaped nozzle body 18 which the hub 17 is able to engage in a close fit recessed and which is likewise pentrated by the spindle 15. The spindle 15 protrudes downwards as far as a hub shaped spindle mount 19 in which the spindle is arranged firmly seated by the its lower end relative to the unit 4. The bodies 9, 18 configured integrally to each other are mounted rotatable about the spindle 15 but not axially shiftable.

The body 18 forms at its upper end as well as recessed within the head 9 a nozzle array 20 oriented axially only as regards the inlets 16 and not as regards the longitudinal openings of the grooves 11, this nozzle array comprising nozzle units 21 distributed evenly about the spindle 10, the number of which is substantially smaller than the corresponding number of arrays 7, 11 to 14 or 16 or half thereof; in this case four units 21 evenly distributed equidistantly about the spindle 10 are provided so that two units 21 oppose each other in each case on both sides of the spindle 10 in their common axial plane and the average angular spacing between adjacent units 21 amounts to 90°. The units 21 are located in a common plane at right angles to the spindle 10, the inlets 16 also being located in such a plane or face surface area spaced away from the upper face surface area of the body 18 by an amount which is smaller than the groove depth at the inlets 16.

Figure 4:
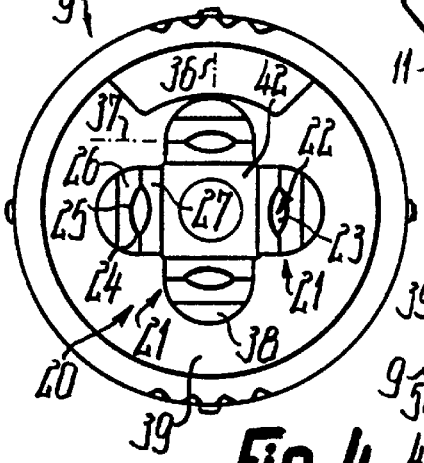
FIG. 4 is an axial view against the direction of flow of the nozzle head as shown in FIG. 3.
Figure 5:
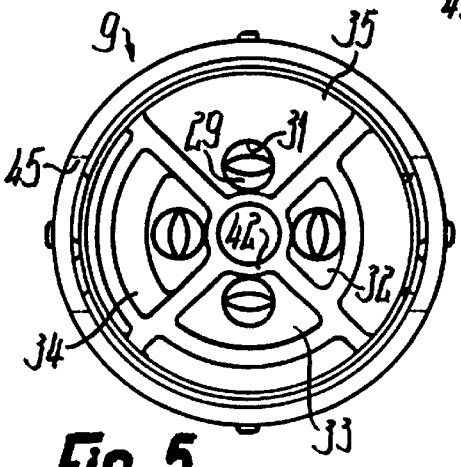
Figure 3:
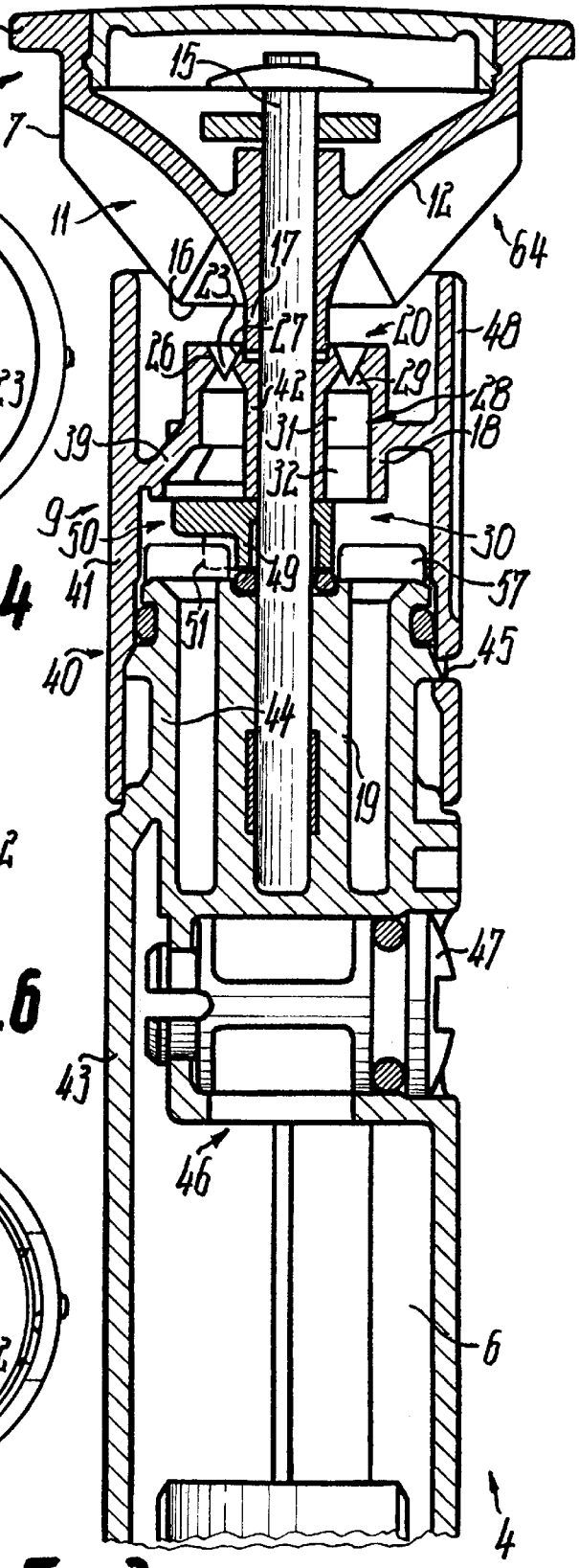
FIG. 3 shows the upper end of the sprinkler unit as shown in FIG. 1, but here on a magnified scale.

Each unit 21 comprises a sole jetting nozzle 22 or nozzle orifice 23 which as shown in FIGS. 4 and 5 is lenticular to such a degree that it forms two mutually opposed and acutely flared narrow sides 24 and two broadsides 25 facing each other at right angles transversely thereto, defined by two mutually opposed concave identical definitions of the nozzle orifice 23. These definitions or the broadsides 25 are located in a common plane 36 which is an axial plane of the spindle 10. The narrow sides 24 are located in a plane 37 at right angles to the latter. The smaller width of the nozzle orifice 23 is located parallel to the plane 36 and may be maximally or minimum half or a third respectively smaller than the largest width parallel to the plane 37. At the narrow sides 24 the concave definitions 25 sharply translate into each other at an acute angle. All orifices 23 have the same middle radial spacing from the spindle 10.

The orifices 23 passing through the body 18 are located radial slightly outside of the outer circumference of the lower hub end 17 and radial totally within the radial outer definitions of the inlets 16 as well as recessed within the face end wall of the body 18. Each orifice 23 adjoins one or two guiding surface areas or flat flanks 26, 27 facing each other, each of which face each other on one side of the plane 37 like the definitions 25 symmetrically opposed and inclined at an acute angle slantingly outwards since they are formed by an acutely angled V-shaped groove having open groove ends. These grooves flared in the direction of flow pass through the upper face or enveloping surface area of the body 18 so that the water flows from here without contact up to the inlets 16, it thereby needing to have contact with the sprinkler 1 only at the outer circumference of the lower hub end 17.

In this arrangement the water parting from the broad edge 25 in each case is directed against the opposite flank 26 or 27 so that intersecting flows materialize which flow fan-shaped or oriented parallel against the inlet end 16 of the head 8. Due to the flanks 26, 27 the narrow sides 24 are located recessed relative to the middle portions of the broadsides 25, these middle portions dropping continually towards the narrow sides 24. The flanks 26, 27 protruding beyond both sides of the narrow sides 24 parallel to the larger extent of the orifice 23 have the effect in conjunction with the orifices 23, that the jet emerging in each case with the head 23 stationary enters simultaneously into more than only one or two inlets 16. The inlets 16 defining the tips of the protuberances 14 are located circumferentially substantially nearer to each other than the outlets 7. Adjacent jets of adjacent units 21 intermingle, however, not at all or merely unsubstantially prior to attaining the inlets 16 and up to the orifices.

The clear arc spacings between adjacent orifices 23 are greater than their width. The unit 21, 23 extends about the spindle 10 over an acute angle of maximally 60° or 45°. Each orifice 23 or each guide means 26, 27 is formed by the downstream end of a nozzle passage 28, the latter comprising several axially adjacent portions each differing in cross-section, totally located within the body 18 and like the surface areas 26, 27 integrally defined thereby. At the inlet end of the passages 28 positioning means 30 are provided with which an optional number of passages 28 or orifices 23 can be opened or closed so that the water flows through them or not.

The orifice 23 is formed by the end of a portion 29 of the passage 28 constricted in the direction of flow at an acute angle, where necessary, at right angles or at an obtuse angle. This end section 29 comprises at its upstream end a central symmetrical or circular cross-section from which it translates continually and with diminishing flow cross section into the shape of the orifice 23 so that here a strong acceleration of flow materializes. Adjoining the inlet of the section 29 is a cylindrical section 31 having the same width and in the same axis but greater in length than the section 29. Adjoining the latter is a curved section again wider and having the form of an annular sector centered about the spindle 10 which forms a separate inlet or control chamber 32 to 35 for each corresponding passage 28. The sections 23 to 35 separate from each other within the body 18 differ in their radial extent such that it increases incrementally from the smallest section 32 to the largest section 35 in one direction about the spindle 10; this applying likewise to the radial spacings of the radial outer definitions of the sections 32 to 35, the radial inner definitions of which have the same radial spacings from the spindle 10 and which, like the chambers 32 to 35 assume the same angle of an arc about the spindle 10. The sections 32 to 35 are located symmetrically to the corresponding planes 36. Their inlets are located in the lower upstream and flat face and end surface area of the body 18.

Each nozzle unit 21 to 28 is provided on a separate protuberance 38 of the body 18 through which it passes, the protuberance emanating from an annular face end wall 39 in the direction of flow and protruding radially as shown in FIG. 4 so that the outlet end of the body 18 has the shape of a cross or star as shown in FIG. 1 and each arm of which forms a protuberance 38. The face end wall 39 is located between and spaced away from the ends of the body 18, integrally adjoins the outer circumference or the like and is flat over the majority of its circumference, whereby it may be also be inclined in the region of a chamber 34 as a kind of conical sector.

The body 18 is mounted by its mount 40 manually movable and rotatable relative to and directly at the unit 4 for adjusting the positioning means. For this purpose the body 18 forms a unit integrally with a mounting body or shell 41 which forms the upper end or in the corresponding axial portion the exposed outer circumference of the unit 4 and in which it is located totally recessed as well as radial spaced away from the body 18 full length. The latter adjoins via the connection 39 directly the inner side of the shell 41. Directly within the passages 28 the body 18 forms radially a hub 42 by which the bodies 9, 18, 41 are rotatably mounted about the spindle 15 and which defines the chambers 32 to 35 by its outer circumference in the radial inner portion. The outer circumference of the unit 4 which is exposed in operation, is formed over the majority of its length by a tubular passage body 43, has constant cross-sections over the majority of its length and forms the upper end of a raised face 44 of the mount 40 constricted in its outer circumference. The end 44 is rotatably clasped by the shell 41 spaced away from the lower end of the body 18 and protruding downwards beyond this end. The outer circumference of the shell 41 forms a smooth continuation of the outer circumference of the passage body 43 adjoining the raised face 44. The unit 9, 18, 41 may be axially located by the head 8 and a shell of the body 43 in both opposing directions.

This unit 9, 18, 41 is to be defined in each rotatable position by a latching or snap-action locator 45 relative to the unit 2 to 4, whereby this locator 45 may also form an axial locator. The latter comprises a snap-action cam protruding beyond the outer circumference of the raised face 44 which engages latching orifices or through-orifices in the shell 40 flexibly so that the latching force can be overcome by manually turning the nozzle head 9. The corresponding handle 48 is formed by the outer circumference of the shell 41 of the head 9. The number of latching positions provided is the same as the number of the nozzle units 21, namely four, so that the head 9 is to be turned from one position to the next through 90° with which the sprinkler 1 may be used to sprinkle optionally about the spindle 10 a sector of 360°, 270°, 180° and 90° each. The sector to be sprinkled is thus a whole number multiple of the smallest sector in each case.

Provided in the passageways 6 within the unit 4 and upstream of the positioning means 30 is a control valve 46 with which the flow cross sections of the passageways 6 can be continually varied or shut off completely. The valve 46 comprises, located radially to the axis 10 totally recessed within the body 43, a valve element 47 freely accessible in the operating position at the outlet end of the unit 47 adjacent to the lower end of the head 9 and located in the resting position as shown in FIG. 1 recessed within the unit 3. The valve 46 comprises a valve body configured integrally with the body 43, the valve part 47 being inserted in the valve body rotatably about the transverse axis and axially located by a snap-action locator configured integrally with both valve parts. Like the handle 48 the valve element 47 is accessible in the extended operating position at the outer circumference of the body 43 for direct manual actuation, it being however totally recessed in the unit 3 in the retracted position as shown in FIG. 1.

Figure 6:
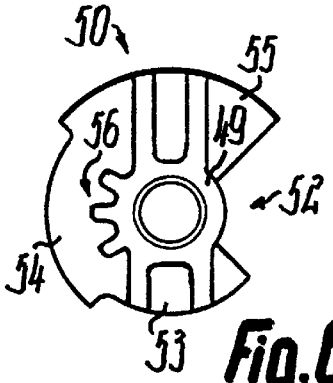
FIG. 5 is an axial view in the direction of flow of the nozzle head and FIG. 6 is an axial view of the control element of the positioning means as shown in FIG. 3 and in a position in which in accordance with the position as shown in FIG. 5 all nozzle units are opened.

The control means 30 comprise a one-part control element 50 which is penetrated in a hub 49 by the spindle 15 and with respect thereto the control element is motionless on adjustment of the device 30 since it lockingly engages the unit 4 or body 43 to prevent any movement or turning action via a locator 51. As explained relative to the passage sections 32 to 35 the control element 50 comprises control sections 52 to 55 in the same distribution of which one forms the sector 52 free up to the hub 4, whilst the others form cams 53 to 55 emanating from the hub 49 radially extending in differing increments. In translating the position of the control element 50 as shown in FIG. 6 to the position of the sections 32 to 35 as shown in FIG. 5 the sector 52 is located over the smallest section 32, the smallest cam 53 over the next larger section 33, the next largest cam 54 over the in turn next larger section 34 in such a way that along the outer circumference of each cam 53 to 55 a flow cross-section or an orifice as a connection to the corresponding chamber 33 to 35 having the shape of an annular sector remains free for the inflowing water and also the chamber 32 is connected. When, however, the control element 50 is turned clockwise relative to the control element 50 by one switching increment then the cam 55 closes off the chamber 32 completely, whilst the flow cross-sections to the remaining chambers 33 to 35 are correspondingly radially opened up due to the sector 52 then completely opening up the chamber 33 and the cams 53, 54 cover the chambers 34, 35 less, This results also when incrementing switching further by the next increment, the chambers 32, 33 then being totally closed off, etc.

Belonging to the position locator 51 the control element 50 features a locating member 56, more particularly, one or more tooth-like locator cams protruding beyond the outer circumference of the hub 59 or the lower face surface area of at least one cam 54 which engage the mating member 57 for a positive rotational location. This member 57 is provided at the upper end of the body 43 or the raised face 42 as a kind of face toothing on all sides of the spindle 10 so that the element 50 can be connected practically continually in any required rotary position to the unit 4. On axial release or removal of the head 9 also the control element 50 can be axially released or removed and reinserted in the plane 51 in a changed rotary position axially. The hub 49 protrudes beyond only the side of the cams 53 to 55 facing away from the passages 48 so that the upper face surface area of the element 50 or of all cams 53 to 55 is located in a common plane and adjoins the corresponding face surface area of the control element 18 in a tight or pressure seal. This sealing pressure is produced by a spindle mount arranged about the spindle 15, like a sealing ring.

Arranged at the lower end of the body 43 is an annular piston 58 located solely by radial flaring and subsequent return spring action to snap into place in a circumferential groove of the body 43 which runs on a cylindrical surface area in the interior of the unit 3. The outer circumference of the unit 4 is surrounded by a spring 59 which is supported by the face surface areas of the piston 58 and in the upper region of the unit 3 in such a way that the cross-section 59 always urges the unit 4 downwards. The water entering the connection 5 acts on the piston 58 and causes the unit 4 to travel against the action of the spring 59 up to the stop upwards out of the unit 3.

The unit 3 comprises a tubular housing body 60 configured integrally with the radial protuberance port 5, the housing body forming the path for travel of the piston 58 and at the upper end of which a cover 61 is releasable secured by screws with a seal 62 interposed. The ring shaped seal 62 releasably clamped between the cover 61 and the upper end of the body 60 is in contact in each position sealingly of the outer circumference of the unit 4, namely of the head 9 and the body 43 and serves to support the upper end of the spring 59. As shown in FIG. 1 except for an end flange 63 the head 8 is located totally within the unit 3 or cover 61. Due to the flange 63 adjoining the upper face surface area of the cover 61 the unit 4 is defined by a stop in the retracted position.

On commencing operation of the sprinkler 1 the water inflowing through the connection 5 forces the unit 4 firstly from the unit 3 so that the body 60 is filled with water completely up to the piston 58. The water then flows through a filter and the interior of the body 43, then through the valve 46 and from there in an accelerated flow through a annular gap between the raised faces 19, 44 as well as through the locator 51 directly into a chamber accommodating the control element 50 within the head 9. Depending on the position of the control element 50 the water flows from here directly into one or more chambers 32 to 35, then from there, further accelerated, into the corresponding passage sections 31 as well as again accelerated into the passage sections 29 so that it then emerges as a wide jet from the corresponding nozzle orifices 23. The lower conical end of the head 8 protrudes into the upper end of the shell 41 to such an extent that in this end the inlets 16 are located into which the water enters in the manner as described directly from the orifices 23. Only this lower end of the head 8 forms by the vane-like protuberances 14 a turbine rotor 64 which is then driven by the water, in which the water is directed substantially only within the grooves 11 to the outlets 7. Although several rotors are feasible, only a single rotor 64 or no rotor is provided which is driven via an intermediate gearing, a clutch or the like and is rotatable relative to the other rotor. It is only as of the outlets 7 that the water is then discharged without contact so that it impinges the area to be sprinkled extending from near to the device 1 up to a relatively large distance away.

As regards further features and effects reference is made to the German laid-open patent 44 29 952 as to how they relate to the present invention. All cited effects and properties may be precisely as described, merely roughly so or substantially so and may, where necessary, also greatly vary therefrom. Parts and connections described as being releasable are releasable non-destructively as well as where necessary directly manually without the aid of tools.

I claim:

1. A sprinkler comprising:

a stationary sprinkler base (2, 4);

a duct system (6) including a supply connection (5) and a fluid outlet (7) for discharging a fluid away from said sprinkler (1), and a nozzle unit (20) included in said duct system (6) and located upstream of said final outlet (7), said nozzle unit (20) including at least one jet nozzle (22) directed against a guide surface (11), said jet nozzle (22) including a nozzle duct (28) bounded substantially entirely in one part and issuing at a nozzle exit, said jet nozzle (22) defining a nozzle axis and a jet cross-section, said jet cross-section being non-circular, wherein in a longitudinal cross-section said nozzle duct (28) includes at least one non-axial duct flank (26, 27).

2. The sprinkler according to claim 1, wherein in a transverse cross-section said nozzle duct (28) is non-circular and defines axial first and second nozzle planes (36, 37), said first nozzle plane (36) being oriented transverse to said second nozzle plane (37), along said first nozzle plane (36) said nozzle duct being smaller than along said second nozzle plane (37), thereby defining first and second duct extensions.

3. The sprinkler according to claim 1, wherein said nozzle duct (28) defines axial extensions varying around said nozzle axis.

4. The sprinkler according to claim 1, wherein said nozzle unit (21) includes a plurality of said at least one jet nozzle (22) evenly distributed about a central axis (10).

5. The sprinkler according to claim 2 and further defining a central axis (10) radially spaced from said nozzle axis, wherein said first duct extension is oriented toward said central axis (10) and is smaller than said second duct extension.

6. The sprinkler according to claim 1, wherein said guide face (11) is non-linear when seen in axial view parallel to said nozzle axis.

7. The sprinkler according to claim 1, wherein in transverse cross-section said nozzle duct (28) defines axial first and second nozzle planes (36, 37), said first nozzle plane (36) being oriented transverse to said second nozzle plane (37) and defining a central axis (10) spaced from said nozzle axis, in said transverse cross-section said nozzle duct (28) being substantially mirror-symmetrical with respect to said second nozzle plane (37).

8. The sprinkler according to claim 2, wherein in said transverse cross-section said nozzle duct (28) is lenticular.

9. The sprinkler according to claim 1, wherein said nozzle exit includes a nozzle opening (23) circumferentially entirely bounded by a nozzle edge of said nozzle duct (28), said nozzle edge including circumferentially distributed edge sections axially displaced with respect to each other.

10. The sprinkler according to claim 1, wherein said nozzle duct (28) widens toward said nozzle exit.

11. The sprinkler according to claim 1, wherein said nozzle exit includes a nozzle opening (23) circumferentially entirely bounded by a nozzle edge made in one part, said nozzle duct (28) narrowing up to said nozzle edge.

12. The sprinkler according to claim 11, wherein said nozzle edge is annular, said nozzle duct (28) widening down-stream from said nozzle edge.

13. The sprinkler according to claim 1, wherein said jet nozzle (22) includes a nozzle protrusion (38) traversed by said nozzle duct (28), said nozzle protrusion (38) radially extending with respect to a central axis (10) spaced from said nozzle axis.

14. The sprinkler according to claim 1 and further including a sprinkler runner (64) driven by said nozzle unit (20) and including said guide face (11), wherein said guide face (11) axially extends upstream at least up to said nozzle duct (28).

15. The sprinkler according to claim 1 and further including a sprinkler rotor (64) rotably mounted on an axel rod (15), wherein a nozzle head (9) is included and includes said jet nozzle (22), said nozzle head (9) being operationally displaceable with respect to said sprinkler base (4) and including an axially oblong hub sleeve (42) directly connecting to said axel rod (15).

16. The sprinkler according to claim 1 and further including a nozzle head (9) including said jet nozzle (22), wherein securing means (45) are included for axially securing said nozzle head (9) with respect to said sprinkler base (4), said securing means including interengaging securing members, at least one of said securing members traversing said nozzle head (9) radially.

17. The sprinkler according to claim 1 and further including control means (30, 46), for varying flow of the fluid out of said nozzle unit (20), wherein said nozzle unit (20) includes a plurality of said at least one jet nozzle (22) including juxtaposed first and second said nozzle duct (28), said control means (30, 46) including a first supply chamber (32 to 34) directly connecting to said first nozzle duct (28) and a second supply chamber (23 to 35) directly connected to said second nozzle duct (28), said first and second supply chambers (32 to 35) being located upstream of said first and second nozzle ducts (28) and downstream of said supply connection (5), said control means (30, 46) individually and commonly opening and closing said first and second supply chambers (32 to 35) with respect to said supply connection (5).

18. The sprinkler according to claim 17, wherein said first supply chamber (32 to 34) is bounded in one part with said first nozzle duct (28) but wider than said first nozzle duct (28).

19. The sprinkler according to claim 1 and further including control means (30) for varying flow of the fluid out of said sprinkler (1), said control means (30) including directly interengaging first and second control members (18, 50), wherein said second control member (50) is positionally held with a holder (51), displacing means (56, 57) being included for displacing and refixing said control member (50) with respect to said holder (51) and without distruction, thereby achieving varying control positions of said second control member (50) with respect to said holder (51).

20. The sprinkler according to claim 1 and further including control means (46) for varying flow of the fluid out of said sprinkler (1), wherein said control means include a control valve (46), for manual operation said control valve (46) being accessible at a base circumference of said sprinkler base (4).

* * * * *